United States Patent [19]

Arends et al.

[11] Patent Number: 4,827,696

[45] Date of Patent: May 9, 1989

[54] APPARATUS FOR GASSING OPEN TOP CANS HAVING A NEWLY FILLED BUBBLING LIQUID THEREIN

[75] Inventors: Craig W. Arends, Tinley Park; Robert Lam, Glen Ellyn, both of Ill.

[73] Assignee: Continental Can Company, Inc., Norwalk, Conn.

[21] Appl. No.: 183,226

[22] Filed: Apr. 19, 1988

[51] Int. Cl.[4] ..... B65B 31/04; B65B 39/00

[52] U.S. Cl. ..... 53/432; 53/471; 53/510; 141/64; 141/70

[58] Field of Search ..... 53/432, 471, 87, 88, 53/97, 510, 281; 141/64, 70

[56] References Cited

U.S. PATENT DOCUMENTS

| | | | |
|---|---|---|---|
| 2,604,247 | 7/1952 | Andre | 53/432 X |
| 2,630,957 | 3/1953 | Hohl et al. | 53/432 X |
| 2,630,958 | 3/1953 | Hohl et al. | 53/432 X |
| 2,672,420 | 3/1954 | Jeremiah | 53/432 X |
| 3,088,831 | 5/1963 | Fauth et al. | 53/432 X |
| 3,289,383 | 12/1966 | Foss | 53/432 |
| 3,556,174 | 1/1971 | Gibble et al. | 53/510 X |
| 3,881,300 | 5/1975 | Zetterberg | 53/510 X |
| 4,602,473 | 7/1986 | Hayashi et al. | 53/432 X |
| 4,703,609 | 11/1987 | Yoshida et al. | 53/432 X |

*Primary Examiner*—Horace M. Culver

*Attorney, Agent, or Firm*—Charles E. Brown; Paul Shapiro; Charles A. Brown

[57] ABSTRACT

A gassing apparatus for breaking bubbles at the surface of a newly filled bubbling product (beer) and thereafter removing air from the head space above the surface of the product. The gassing apparatus includes a new bubble breaker which provides for the breaking of the bubbles at lower than customary gas pressure followed by a gassing rail which is of sufficient length and gassing apertures to permit full air removal notwithstanding variations in head space. Preferably the bubble breakers are used in pairs with the gas in the second bubble breaker being at a pressure less than that in the first.

18 Claims, 2 Drawing Sheets

PRODUCT WAVE CONDITION
FILL LEVEL VARIATION

PRODUCT WAVE CONDITION
FILL LEVEL VARIATION 6
32
60
38
C
6
4
30
4
36
34
30
C
16
14
12
10
C
18
26
12
20
22
24
C

APPARATUS FOR GASSING OPEN TOP CANS HAVING A NEWLY FILLED BUBBLING LIQUID THEREIN

This invention relates in general to new and useful improvements in apparatus for filling cans with a bubbling liquid and breaking such bubbles and removing air from the head space of such cans before the cans are closed.

Most particularly, this invention relates to the filling and closing of cans with a bubbling liquid such as beer.

It is to be understood that in order that the oberall size of a can may be held to a minimum, the head space within a can is also to be held to a minimum. However, when the can is to be filled with a bubbling liquid, such as beer, the can cannot be filled to the extreme top because the bubbles will run out of and down over the side of such can. Therefore, it is necessary to fill the can to a level where the bubbles will be retained in the can. Thereafter it is necessary to break the bubbles to release air contained therein in a manner which will result in substantially none of the liquid being directed out of the open top of the can. In a final step, a gas is directed into the head space of a can to remove air therefrom.

In conjunction with a standard 12 ounce can, at least one beer requires that the air retained within the can be no greater than 0.5 ml while restricting product spillage. If any can tested shows an excess of air, it is necessary that the line be shut down and adjusted so as to make certain that no other cans containing more than 0.5 ml air be processed.

A basic apparatus for gassing open top cans having a newly filled bubbling liquid therein is found in the patent to Boyd et al U.S. Pat. No. 2,854,039 wherein $CO_2$ is directed into an underlying passing can as a plurality of jets formed by grooves in side plates. While this arrangement effectively breaks the bubbles, it also blows the liquid out of the top of the can.

Jeremiah U.S. Pat. No. 2,672,420 also has to do with an apparatus for conditioning cans of foaming liquids, but directs steam into the top of the cans. Steam, of course, would be objectionable with respect to beer.

Harmon et al U.S. Pat. Nos. 2,950,587 and 2,962,060 have to do with applying $CO_2$ to a gas jar by providing a tunnel arrangement.

Other patents, including Jantze et al U.S. Pat. Nos. 3,545,160 and Domke 4,140,159 have to do with the flushing of air from cans utilizing an inert gas. The air may be purged either from the head space or from an empty container prior to filling.

In accordance with this invention, there has been devised an apparatus for gassing open top cans having a newly filled bubbling liquid therein wherein the bubbles are first broken up by injecting very fine streams of a gas, preferably an inert gas, serially into the open top of a can as the can moves between a filler and a closing machine. This de-bubbling may be repeated if desired. It is then followed by the passage under a gassing rail wherein remaining air in the head space of the can is removed by the introduction of an inert gas into the head space. Further, as is conventionally practiced, when end units for closing the open tops of the cans are directed onto the cans, this occurs in a gaseous atmosphere so as to prevent the reintroduction of air into the head space of the can.

The net result of the apparatus which is the subject of this invention is the removal of air from the head space of a can newly filled with beer and the like to the extent that there remains in an average can only on the average of 0.21 ml air content with less than one percent of all tested cans showing an air content above 0.5 ml.

With the above and other objects in view that will hereinafter appear, the nature of the invention will be more clearly understood by reference to the following detailed description, the appended claims, and the several views illustrated in the accompanying drawings.

Figures 1, 2, 3:
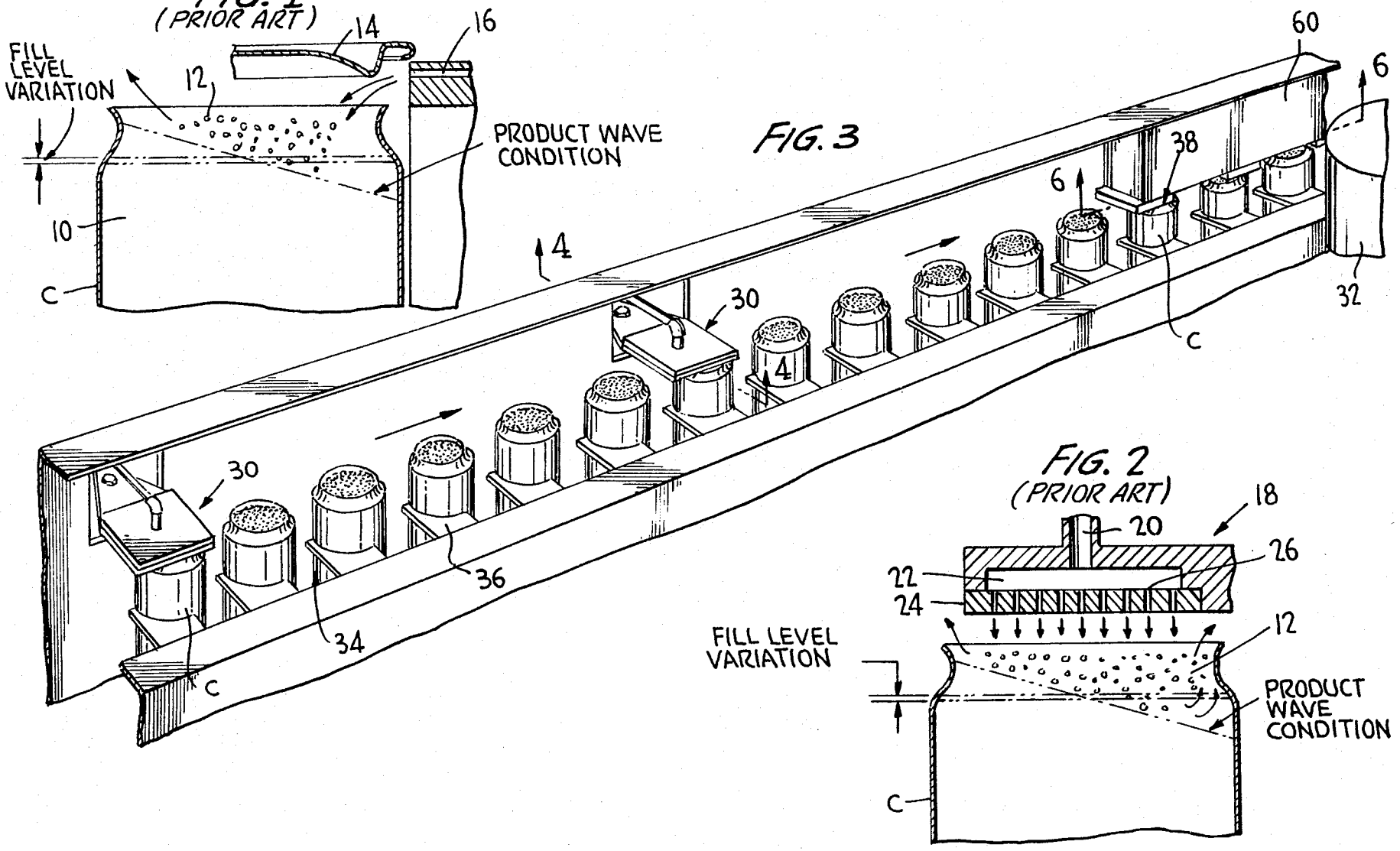
FIG. 1 (PRIOR ART)
FIG. 2 (PRIOR ART)
FIG. 1 is a vertical sectional view taken through the upper part of a filled can wherein the bubbles are being broken by a prior art bubble breaker.
FIG. 2 is a fragmentary vertical sectional view similar to FIG. 1 and shows a prior art gassing device.
FIG. 3 is perspective view showing the gassing apparatus which is the subject of this invention.

Referring first to FIG. 1, it will be seen that there is illustrated what is generally known in the trade as nozzle gassing. A conventional can C is filled with a bubbling liquid 10, such as beer, with bubbles 12 occupying the upper portion of the can, which upper portion is generally known as the head space. Just prior to the closing of the can C by an upper end unit 14, a suitable inert gas, such as $CO_2$, is directed through a nozzle 16 under the end unit 14 and into the head space of the can C. The net result is that the bubbles are primarily driven out of the can as opposed to being broken. A product wave condition is effected, as shown on the drawing, with the result that the bubbles 12 exit out of the top of the can C remote from the nozzle 16. This results in the loss of certain of the product so that there may be a fill level variation as also shown on the drawing.

While gassing at this point is desirable and is continued in accordance with the invention, nozzle gassing per se does not solve the problem.

It has also been proposed to remove the bubbles 12 by rail gassing as shown in FIG. 2, utilizing a rail gasser generally identified by the numeral 18. The rail gasser 18 delivers an inert gas, such as $CO_2$, through a supply pipe 20 into a chamber 22 which overlies a perforated plate 24. The perforated plate 24 has formed therein a series of apertures 26 which are relatively large, i.e. on the order of 1/16 inch and larger. This heavy gassing also produces a wave action in the top of the can C, as shown, with the bubbles being forced out of the can as with the result that certain of the product is driven from the can. The net result is also a fill level variation as indicated in FIG. 2.

In accordance with this invention, there has been developed a bubble breaker which will break up the bubbles 12 in advance of gassing. Such a bubble breaker is generally identified by the numeral 30 and there may be two of such bubble breakers 30, as is shown in FIG. 3.

With respect to FIG. 3, cans C are delivered from a conventional filler (not shown) towards a closing machine 32. In order that the cans C may be rapidly moved by being maintained in their upright position and equally spaced, there are provided suitable conventional conveyor means, generally identified by the numeral 34. The conveyor means 34 will include a moving support (not shown) on which the cans C are seated. Associated with the moving support and moving in unison therewith is a plurality of positioning elements 36, one for each of the cans C.

In accordance with this invention, each newly filled can of bubbling liquid (beer) passes under at least one of the bubble breakers 30 so as to break up the bubbles and thus release air entrapped within the bubbles, followed by the passage of each can C beneath a gassing rail, generally identified by the numeral 38, which is positioned immediately adjacent the closing machine 32. As soon as the cans C pass from under the gassing rail 38, they receive an end unit, such as the end unit 14 of FIG. 1, with there being further gassing similar to that shown in FIG. 1, but at a lesser velocity so as to prevent any loss of the liquid product. Each can, with substantially all of the air in the head space thereof removed, then has the end unit 14 secured thereto in sealed relationship by the conventional operation of the closing machine 32.

Figure 4:
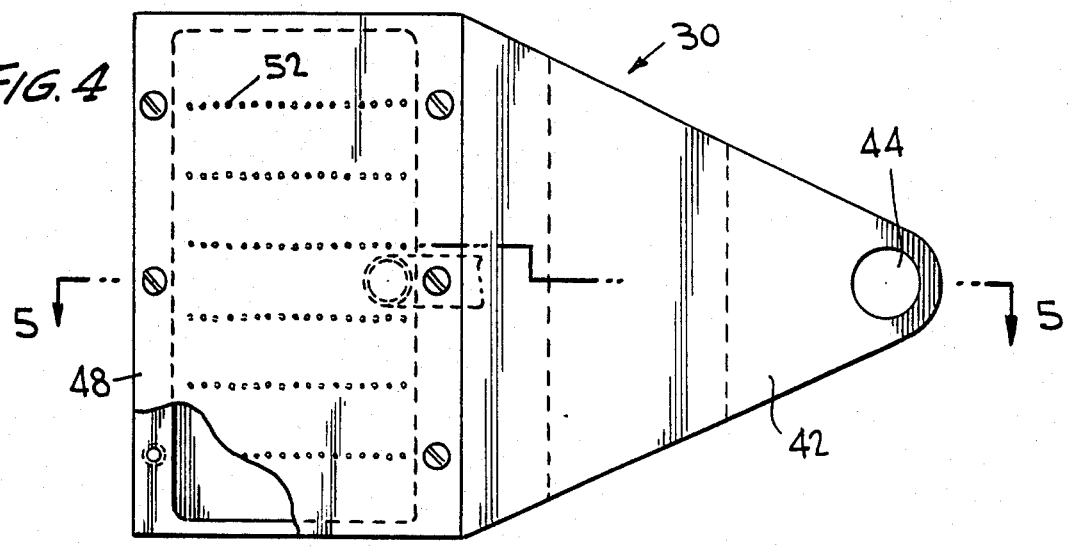
FIG. 4 is an enlarged fragmentary horizontal view taken generally along the line 4—4 of FIG. 3 and looking at the underside of a bubble breaker formed in accordance with this invention.
Figure 5:
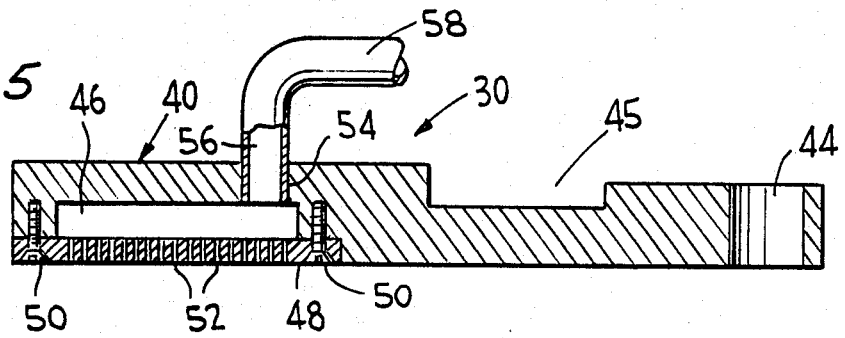
FIG. 5 is a vertical sectional view taken generally along the line 5—5 of FIG. 4 and shows the details of the bubble breaker.

Referring now to FIGS. 4 and 5, it will be seen that the bubble breaker 30 includes a plate member which may be described as being a nozzle plate 40. The nozzle plate 40 has a generally triangular mounting portion 42 including an apex portion having a bore 44 therethrough for receiving a mounting bolt. The triangular portion 42 is provided with a transverse notch 45 for receiving a mounting bar or the like (not shown).

The nozzle plate 40, remote from the bore 44, is rectangular in outline and has formed in the underside thereof a chamber 46. The chamber 46 opens to a recessed portion of the nozzle plate 40.

An apertured plate 48 is recessed in the underside of the nozzle plate 40 and closes the underside of the compartment 46. The plate 48 is held in place by removable fasteners 50.

As will be readily apparent from FIG. 4, the apertured plate 48 is provided with a series of transversely extending rows of minute bores 52. The bores 52 are preferably formed with a number 72 drill which has a diameter on the order of 0.025 inch. Adjacent bores 52 in a row are preferably spaced on the order to 0.140 inch. The rows of bores 52 are preferably spaced apart longitudinally of the apertured plate 48 a distance on the order of ⅝ inch.

The nozzle plate 40 above the compartment 46, is provided with a nozzle opening 54 which opens through the top of the nozzle plate 40. A suitable nozzle 56 extends through the nozzle opening 54 for directing a gas under pressure into the compartment 46. The nozzle 56 has connected thereto a gas supply line 58.

The second bubble breaker 30 may be of the same construction as the bubble breaker 30 illustrated in FIGS. 4 and 5. However, in operation, the pressure of the gas supplied to the second bubble breaker may be different from that supplied to the first as will be described in more detail hereinafter.

As stated above, the closing machine 32 is only schematically illustrated. However, it is to be understood that the closing machine 32 will include a chute 60 down which end units, such as the end unit 14, move in sequence to be seated on each can C as it enters the closing machine 32. The gassing rail 38 may be suitably mounted on the underside of the chute 60, as shown in Figure 3.

Figure 7:
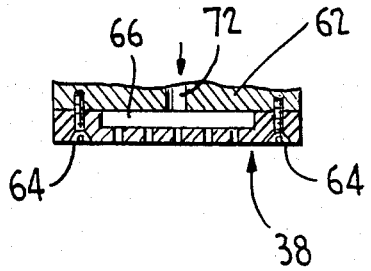
FIG. 7 is an enlarged fragmentary transverse vertical sectional view taken generally along the line 7—7 of FIG. 6 and shows more details of the gassing rail.

As is best shown in FIG. 7, the gassing rail 38 is mounted on the underside of a mounting plate 62 by means of fasteners 64. The gassing rail 38 has formed in the upper surface thereof an elongated compartment 66 which may be provided with rounded ends 68.

Figure 6:
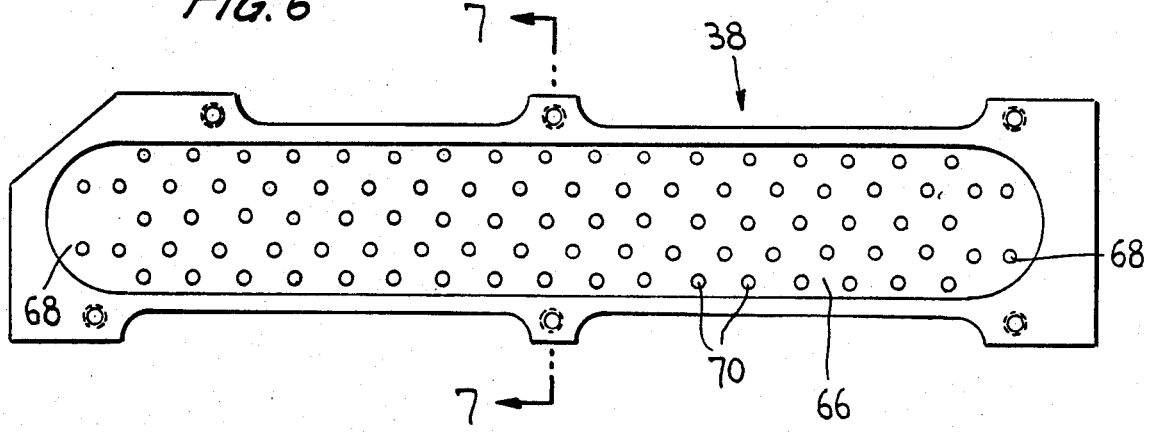
FIG. 6 is a bottom plan view of a gassing rail taken generally along the line 6—6 of FIG. 3.

The gassing rail 38 is provided with a plurality of bores 70 which are arranged in columns and with the bores 70 in adjacent columns being in offset relation as is clearly shown in FIG. 6. The bores 70 are relatively large as compared to the minute bores 52 and are preferably formed with a 1/16 inch diameter drill. It may be said that the bores 70 are arranged in diagonal rows as well as in columns.

In order that an inert gas, such as $CO_2$ may be directed into the compartment 66, the mounting plate 62 is provided with an opening 72 which extends therethrough. The opening 72 is intended to receive a fitting for a gas line (now shown).

At this time, it is pointed out here a number of factors are involved in order to have proper gassing. First of all, as pointed out above, the bubble breaking should be effected without driving the bubbles and liquid out of the can as has occurred in the past. Next, it is necessary that not only should there be gassing to fill the head space in the can, but also as much as possible of the air. Finally, and most particularly, the use of the inert gas ($CO_2$) should be restricted as much as possible because of the cost factor.

Prior to this invention, utilizing standard bubble breakers and turret gassing in conjunction with the application of an end unit, one was able to obtain the desired 0.25 ml average air content in the head space. However, the air removal was not consistent and 5.3% of samples had between 0.50 ml and 0.70 ml air content. Further, 0.30% of the samples contained an air content above 0.75 ml.

The standard bubble breakers were replaced with the new bubble breakers while the turret gassing was continued. While less inert gas was required, the net results were not desirable. The average air content was 0.30 ml with 5.4% of the samples having an air content between 0.50 ml and 0.70 ml. Further, 2.7% of the samples had an air content above 0.75 ml.

Thereafter, a gassing apparatus as illustrated in FIG. 3 utilizing two bubble breakers 30 was employed. The pressure of the inert gas in the first bubble breaker 30 was 15 psi while the pressure of the inert gas in the second bubble breaker 30 was reduced to 6 psi. The pressure of the inert gas supplied to the rail gasser was 7.5 psi which is the same as the pressure of the gas delivered to the cover gasser of the turret gassing. There was, also, as in each of the above cases, turret gassing.

Utilizing the gassing apparatus of FIG. 3, the average air content was released to 0.21 ml with only 0.93% of the samples having an air content between 0.50 ml and 0.70 ml and none of the samples had an air content above 0.75 ml.

In summary, with prior bubble breakers, the small orifice size and quantity of orifices provided a very short time increment (approximately 29.6 msec) at present machine speeds of 1850 cans per minute in which to disturb the product surface and break air bubbles adhering to the surface of the product.

In order to accomplish breaking the air bubbles with prior bubble breakers, excessive gas velocities are required which actually blow product out of the can and result in product loss.

The bubble breaker 30 in accordance with this invention provides a longer time increment (approximately 49 msec per bubble breaker) which is a 65% increase in time and a lower flow velocity to adequately remove the air bubble, while at the same time reducing product loss due to the lower flow velocity.

In addition, the bubble breakers 30 "condition" the product surface such that when the containers enter the closing machine, the surface usually is flat to allow head space air evacuation by the rail gasser.

Further, with respect to the rail gasser, with existing head space, in utilizing air removal accomplished by nozzle gassing, the flow pattern and short time increment at present machine speeds cannot adequately handle variations in can head space and provide satisfactory air removal for all cans to the new lower air content specifications. The rail gasser 38 provides an increase of 182% of additional time at 1850 CPM to accomplish head space air removal. In addition to the increased time increment, the vertical flow pattern can adequately handle variations in product fills which cause variations in the amount of head space to be evacuated. This vertical flow characteristic can also handle conditions where a product wave condition cannot be adequately handled by nozzle gassing.

Although only a preferred embodiment of the gassing apparatus has been specifically illustrated and described herein, it is to be understood that minor variations may be made in the gassing apparatus without departing from the spirit and scope of the invention as defined by the appended claims.

We claim:

1. Apparatus for gassing open top cans having a newly filled bubbling liquid therein to reduce quantity of air in a can head space above the liquid, said apparatus comprising downstream of can filling mens and in advance of canclosing means at least one $CO_2$bubble breaker followed by a $CO_2$ gassing rail for displacing air in can head spaces above liquid therein.

2. Apparatus according to claim 1 wherein said bubble breaker includes a downwardly facing plate having a plurality of minute bores extending therethrough, and a supply of $CO_2$ gas under pressure directed against an upper face of said plate.

3. Apparatus according to claim 2 wherein said plate is elongated in the direction of can travel between can filling means and can closing means.

4. Apparatus according to claim 3 wherein said bores are arranged in rows and columns.

5. Apparatus according to claim 3 wherein said bores have a diameter on the order of 0.025 inch.

6. Apparatus according to claim 3 wherein said bores have a diameter on the order of 0.025 inch and are transversely spaced on the order of 0.140 inch.

7. Apparatus according to claim 2 wherein said bores have a diameter on the order of 0.025 inch.

8. Apparatus according to claim 2 wherein said bores have a diameter on the order of 0.025 inch and are transversely spaced on the order of 0.140 inch.

9. Apparatus according to claim 1 wherein said bubble breaker includes a nozzle plate having a downwardly opening chamber defining portion and a mounting bracket forming portion, a downwardly facing apertured plate secured to an underside of said chamber defining portion and closing said chamber, said apertured plate having a plurality of minute bores extending therethrough, and a nozzle opening opening into the chamber for receiving a $CO_2$ gas supplying nozzle.

10. Apparatus according to claim 9 wherein said chamber and said apertured plate are elongated in the direction of can travel between can filling means and can closing means.

11. Apparatus according to claim 9 wherein said bores have a diameter on the order of 0.025 inch.

12. Apparatus according to claim 9 wherein said bores have a diameter on the order of 0.025 inch and are transversely spaced on the order of 0.140 inch.

13. Apparatus according to claim 1 wherein there are at least two of said bubble breakers, and there are separate gas supplies at different pressures.

14. Apparatus according to claim 1 wherein said gassing rail is in the form of an elongated downwardly facing apertured rail, said rail having a plurality of small diameter bores therethrough, and means for supplying a gas under pressure to said rail.

15. Apparatus according to claim 14 wherein said rail has a compartment defining upper portion in communication with said bores.

16. Apparatus according to claim 14 wherein said gassing rail is disposed immediately adjacent said can closing means.

17. Apparatus according to claim 14 wherein said bores have a diameter on the order of 1/16 inch.

18. A method of reducing air content in a head space of a newly filled can containing a bubbling liquid and moving towards can closing means, said method comprising the steps of passing the newly filled can under a bubble breaker providing a plurality of transverse rows of downwardly directed $CO_2$ gas jets to break upthe bubbles, and thereafter passing the can beneath a $CO_2$ gassing rail to drive out remaining air and filling the can head space with gas.

* * * * *